US007305803B2

(12) United States Patent
Correa et al.

(10) Patent No.: US 7,305,803 B2
(45) Date of Patent: Dec. 11, 2007

(54) BLOCK CONSTRUCTION SYSTEM

(76) Inventors: Daniel Correa, 3035 Degen Dr., Bonita, CA (US) 91902; Lorenzo Correa, 527 Chestnut St., Redwood City, CA (US) 94063

( * ) Notice: Subject to any disclaimer, the term of this patent is extended or adjusted under 35 U.S.C. 154(b) by 657 days.

(21) Appl. No.: 10/629,151

(22) Filed: Jul. 29, 2003

(65) Prior Publication Data

US 2004/0020155 A1 Feb. 5, 2004

Related U.S. Application Data

(63) Continuation-in-part of application No. 09/666,490, filed on Sep. 18, 2000, now abandoned.

(51) Int. Cl.
*E04B 5/04* (2006.01)

(52) U.S. Cl. ..... 52/604; 52/503; 52/609; 52/607

(58) Field of Classification Search ..... 52/503, 52/604, 605, 607, 609
See application file for complete search history.

(56) References Cited

U.S. PATENT DOCUMENTS

| | | | | | |
|---|---|---|---|---|---|
| 786,884 | A | * | 4/1905 | Faulkner | 52/289 |
| 894,122 | A | * | 7/1908 | Dougherty | 52/302.4 |
| 1,726,844 | A | | 9/1929 | Larkin | |
| 1,995,477 | A | | 3/1935 | Kotrbaty | |
| 2,012,024 | A | | 8/1935 | Roberts | |
| 2,141,035 | A | * | 12/1938 | Daniels | 202/223 |
| 2,363,405 | A | | 1/1944 | Eichelberger | |
| 2,432,622 | A | | 12/1947 | Johnston | |
| 2,655,032 | A | * | 10/1953 | Zagray | 52/591.1 |
| 2,847,099 | A | | 8/1958 | Gruber | |
| 2,981,383 | A | | 4/1961 | Dunn | |
| 3,418,774 | A | | 12/1968 | Kocher et al. | |
| 3,995,402 | A | | 12/1976 | Parenteau | |
| 4,035,975 | A | | 7/1977 | Gergely | |
| 4,426,815 | A | | 1/1984 | Brown | |
| 4,485,604 | A | | 12/1984 | Palamara et al. | |

(Continued)

OTHER PUBLICATIONS

MCIBS, Inc., "Mortarless Interlocking Money-Saving System-Mortarless Concrete Block Construction", 1981, St. Louis, Missouri.

(Continued)

*Primary Examiner*—Jeanette E. Chapman
*Assistant Examiner*—Basil Katcheves
(74) *Attorney, Agent, or Firm*—Nydegger & Associates

(57) ABSTRACT

A block construction system includes interlocking, self-aligning blocks that can be used to construct structures with mortarless joints. A typical block has a top face that is formed with a raised, substantially flat horizontal portion that extends between a pair of longitudinally aligned rounded edges. Longitudinally aligned horizontal stop surfaces extend from each rounded edge. A bottom face of the block is formed with a pair of longitudinally aligned stop surfaces and a substantially flat portion that is positioned between and recessed from the stop surfaces. For two stacked blocks, the recessed portion of the top block receives and engages the raised portion of the bottom block preventing lateral movement of one block relative to the other. To interlock adjacent blocks on a common course, one end face of each block is formed with a vertically aligned tongue and the other end face is formed with a corresponding groove.

20 Claims, 5 Drawing Sheets

U.S. PATENT DOCUMENTS

| | | | | | |
|---|---|---|---|---|---|
| 4,498,266 | A | | 2/1985 | Perreton | |
| 4,651,485 | A | | 3/1987 | Osborne | |
| 5,022,210 | A | | 6/1991 | Scott | |
| 5,205,675 | A | | 4/1993 | Hamel | |
| 5,339,592 | A | | 8/1994 | Schmid | |
| 5,365,714 | A | * | 11/1994 | Potvin | 52/590.2 |
| 5,421,135 | A | | 6/1995 | Stevens et al. | |
| 5,457,926 | A | * | 10/1995 | Jensen | 52/604 |
| 5,657,597 | A | | 8/1997 | Loftus | |
| 6,053,661 | A | * | 4/2000 | Lewis | 405/36 |
| 6,244,009 | B1 | * | 6/2001 | Cerrato | 52/604 |

OTHER PUBLICATIONS

True Cast Concrete Products, "How to Build Your Own Interlocking Mortarless Concrete Block Wall", Sun Valley, CA.

* cited by examiner

BLOCK CONSTRUCTION SYSTEM

This application is a continuation-in-part of application Ser. No. 09/666,490 filed Sep. 18, 2000 now abandoned. The contents of application Ser. No. 09/666,490 are incorporated herein by reference.

FIELD OF THE INVENTION

The present invention pertains generally to concrete block construction systems. More particularly, the present invention pertains to blocks for constructing walls having mortarless joints. The present invention is particularly, but not exclusively, useful as a concrete block construction system having interlocking, self-aligning blocks.

BACKGROUND OF THE INVENTION

Traditionally, walls constructed using block required mortar joints between courses of blocks and between blocks within a course. One advantage of mortar joints is that they produce a wall having a somewhat aesthetically pleasing, decorative appearance. Specifically, the mortar joints reveal the block pattern (i.e. bond) of the wall, which is often desirable for architectural purposes. On the other hand, the use of mortar joints presents several disadvantages. For one, structures with mortar joints are expensive, in part due to the cost of the mortar material and the labor cost involved in preparing (i.e. mixing) the mortar at the construction site.

In addition to the cost of the mortar, construction using mortar joints tends to be expensive because it is time consuming to apply the mortar and then level and align each block. These construction steps are usually performed by a skilled mason who typically garners a relatively high hourly wage. Another disadvantage associated with a mortar joints is that mortar joints are relatively weak as compared to the remainder of the structure. This is partially due to the fact that the mortar is prepared at the construction site, often under non-optimal conditions. Unlike the mortar joints, concrete blocks are generally strong because they are typically pressure molded at a factory in a controlled environment. Moreover, block walls with weak mortar joints are particularly susceptible to damage if the wall is shaken, for example, during a moderate to strong earthquake.

Mortarless joint construction block systems offer an alternative to the labor intensive process used to prepare structures with mortar joints. These mortarless joint systems often rely on specific features that are formed on the blocks to interlock the blocks and hold the resulting wall together. Once interlocked, a mortar mix can be pumped or poured into holes in the blocks in a relatively non labor-intensive process to produce a wall having excellent structural integrity. In some cases the blocks can be designed for construction of walls that are reinforced using re-bar.

Once the wall is erected, it is often covered with plaster to enhance its appearance. For plaster covered walls, the plaster functions to prevent water from entering the joint between blocks where the water can damage the structural integrity of the wall. On the other hand, it is somewhat costly and time consuming to plaster the entire outside surface of a wall. Accordingly, it is sometimes desirable to use a wall without plaster on some or all of the wall's outside surfaces. However, currently available mortarless joint systems do not effectively prevent water from seeping into the joints between blocks, and accordingly, these system require a surface coating such as plaster to ensure the structural integrity of the block wall is maintained.

Another important factor that must be considered in the design of interlocking block construction systems is their resistance to earthquakes. Strong earthquakes and some moderately strong earthquakes can shake a block wall causing rigid joints between blocks to fracture. Typical interlocking block systems do not allow for any movement at the joints between adjacent blocks. Because of this rigid structure, walls constructed using these systems tend to fail when exposed to moderately strong seismic activity. On the other hand, the present invention recognizes that some movement between adjacent blocks (on the same course and between courses) can prevent cracking during seismic activity. In particular, the present invention recognizes that hinge-type movement between adjacent blocks can allow a wall to withstand relatively strong seismic activity without damage.

In light of the above, it is an object of the present invention to provide concrete block construction systems having interlocking, self-aligning blocks. It is another object of the present invention to provide block construction systems having mortarless joints which are designed to prevent water from seeping into joints between blocks. It is yet another object of the present invention to provide a block construction system for producing walls that can be used without failure in areas that experience frequent seismic activity. Yet another object of the present invention is to provide a block construction system which is easy to use, relatively simple to implement, and comparatively cost effective.

SUMMARY OF THE INVENTION

The present invention is directed to a block construction system having interlocking, self-aligning blocks that can be used to construct walls of various shapes and sizes. Because the blocks lock together, mortar joints between blocks are not required. A typical stretcher block for use in the system has the general shape of a rectangular parallelepiped and includes a top face and an opposed bottom face that each extend longitudinally from a first end face to a second end face. The stretcher block further includes opposed side faces that each extend from the first end face to the second end face.

To interlock and align stretcher blocks on successive courses, the top face of each stretcher block is formed with a pair of raised, substantially flat, substantially co-planar, horizontal portions that are positioned between a pair of longitudinally aligned edges. Each edge is rounded and extends downwardly from a respective flat portion to prevent water from seeping up into the interface between stacked blocks. Between the flat portions, the top face is formed with a longitudinally aligned, rectangular shaped slot. The top face is further formed with a pair of substantially flat, horizontal stop surfaces that extend longitudinally on the top face. Each stop surface is positioned on the top face adjacent a respective rounded edge and thus, each rounded edge extends between a flat raised portion and a respective stop surface.

The bottom face of each stretcher block is formed with a pair of longitudinally aligned stop surfaces and a pair of substantially flat, substantially coplanar portions that are positioned between and recessed from the stop surfaces. The bottom face further includes a pair of curved surfaces that are each shaped to substantially conform to a respective rounded edge on the top face. Each curved surface extends downwardly from the flat portion to a respective stop surface. Between the flat portions, the bottom face is formed with a longitudinally aligned, rectangular shaped, segmented tongue which is positioned on the bottom face for insertion into the top-face slot of a block on an immediately lower course of blocks.

When a first stretcher block is stacked on a second stretcher block, the recessed portion of the top block receives and engages the raised portion of the bottom block preventing lateral movement of one block relative to the other. Also, the slot of the bottom block receives and engages the segmented tongue of the top block preventing lateral movement of one block relative to the other. In addition, the bottom face stop surfaces engage the top face stop surfaces to vertically self-align the first block with the second block. For the block construction system, the curved surfaces and rounded edges are formed with a relatively large radius of curvature, r, allowing for a minor adjustment in the vertical alignment of the blocks, if required.

To interlock adjacent blocks on a common course, the first end face of each stretcher block is formed with a vertically aligned tongue that is positioned approximately midway between the two sides of the block. The vertical tongue is formed with a tongue surface having a relatively large radius of curvature, R. More specifically, the tongue surface extends along the radius of curvature, R, approximately one-hundred eighty degrees (i.e. the vertical tongue is shaped as a semi-circle in a horizontal cross-section through the tongue).

For the construction block system, the second end face of each stretcher block is formed with a vertically aligned groove having a groove surface substantially conformal with the tongue surface. With this cooperation of structure, the vertical groove can receive and engage the vertical tongue of an adjacent block on a common course and establish a hinge joint therebetween. The hinge joint self-aligns and locks the blocks together preventing lateral movement of one block relative to the other, but allows for a minor adjustment in the lateral alignment of the blocks, if required. In addition, the relatively large radius hinge joint accommodates minor vibrations without joint rupture (such as the vibration that may occur during a moderate to strong earthquake).

Other block configurations having some or all of the interlocking structures described above can be included in the block construction system. These other blocks include half-stretchers, end blocks, corner blocks, bond beam blocks, tee blocks, crossing blocks and other specialty blocks. The different block configurations can be combined to construct walls of various shapes and sizes. To accommodate mortar and vertical re-bar, each block is formed with one or more holes to establish vertically aligned passageways. Bond beam blocks are provided for use on selected courses to accommodate horizontal re-bar.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
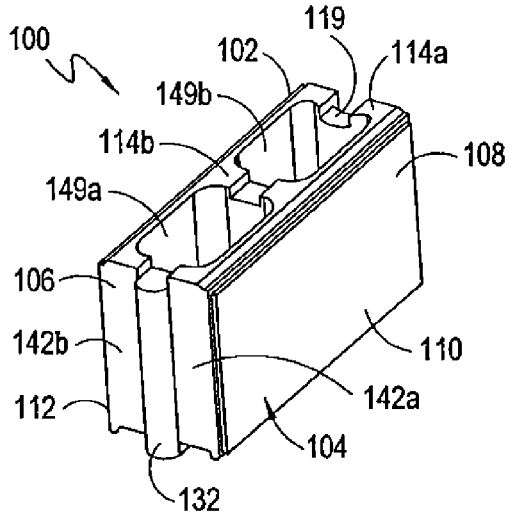
FIG. 1 is a front perspective view of a stretcher block for use in a mortarless joint block construction system.
Figure 2:
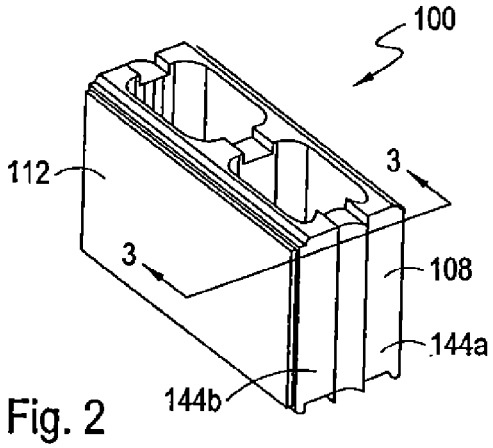
FIG. 2 is a rear perspective view of the stretcher block shown in FIG. 1.

Referring to FIGS. 1 and 2, a stretcher block for use in a block construction system is shown and generally designated 100. As shown in FIGS. 1 and 2, the stretcher block 100 includes a top face 102 and an opposed bottom face 104 that each extend longitudinally from an end face 106 to an end face 108. The stretcher block 100 shown in FIGS. 1 and 2 further includes opposed side faces 110, 112 that each extend from the end face 106 to the end face 108.

Figure 3:
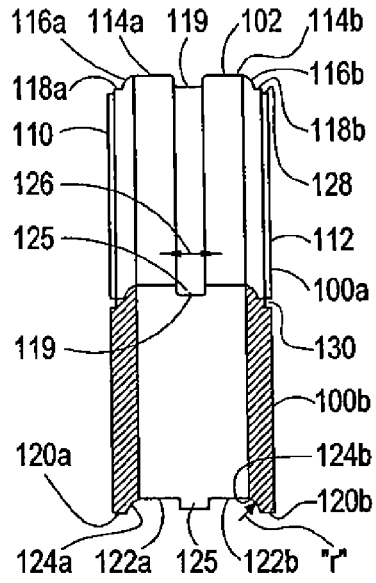
FIG. 3 is a cross sectional view of a pair of stacked blocks as would be seen along line 3-3 in FIG. 2.

With cross-reference to FIGS. 1 and 3, it can be seen that the top face 102 of each stretcher block 100*a,b* is formed with raised portions 114*a,b* that are substantially flat, substantially coplanar and are oriented substantially horizontally. Also shown, the raised portions 114*a,b* extend between a pair of longitudinally aligned edges 116*a,b*. Each edge 116*a,b* is rounded and extends downwardly from a respective raised portion 114*a,b* to prevent water from entering the interface between stacked blocks 100*a,b*. The top face 102 is further formed with a pair of substantially flat horizontal stop surfaces 118*a,b* that each extend longitudinally on the top face 102. Each stop surface 118*a,b* is positioned on the top face 102 adjacent a respective rounded edge 116*a,b* and thus, each rounded edge 116*a,b* extends between the flat raised portion 114 and a respective stop surface 118*a,b*. The top face 102 is also formed with a longitudinally aligned, rectangular shaped slot 119 that is positioned substantially midway between the side faces 110, 112 and separates raised portion 114*a* from raised portion 114*b*.

Continuing with cross-reference to FIGS. 1 and 3, it can be seen that the bottom face 104 of each stretcher block 100 is formed with a pair of longitudinally aligned stop surfaces

Figure 4:
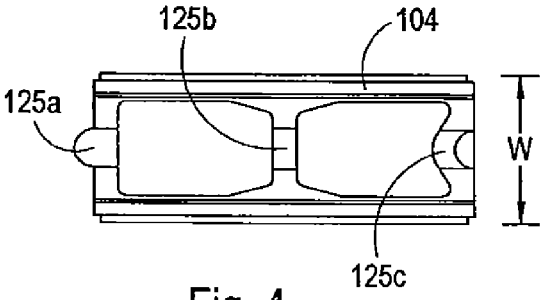
FIG. 4 is a bottom plan view of the stretcher block shown in FIG. 1.

120*a,b* and two recessed portions 122*a,b* that are substantially flat, substantially coplanar and are both positioned between and recessed from the stop surfaces' 120*a,b*. The bottom face 104 further includes a pair of curved surfaces 124*a,b* that are shaped to substantially conform to the rounded edges 116*a,b* on the top face 102, as shown. Further, each curved surface 124*a,b* extends downwardly from the recessed portion 122 to a respective stop surface 120*a,b*. Also, as best seen with cross reference to FIGS. 3 and 4, the bottom face 104 is formed with a longitudinally aligned, rectangular shaped tongue 125 made up of tongue segments 125*a-c* which are positioned on the bottom face 104 and sized for insertion into the slot 119 of a block 100 on an immediately lower course of blocks 100.

As best seen in FIG. 3, when stretcher block 100*a* is stacked on stretcher block 100*b*, the recessed portions 122*a,b* of block 100*a* receive and engage the raised portions 114*a,b* of block 100*b* preventing lateral movement (i.e. movement in the direction of arrow 126) of block 100*a* relative to block 100*b*. Also, the slot 119 of block 100*b* receives and engages one or more of the tongue segments 125*a-c* of the block 100*a*, also preventing lateral movement of block 100*a* relative to block 100*b*. In addition, as shown in FIG. 3, the bottom face stop surfaces 120*a,b* engage respective top face stop surfaces 118*a,b* to vertically self-align block 100*a* on block 100*b*.

FIG. 3 shows that the curved surfaces 124*a,b* and rounded edges 116*a,b* are formed with a relatively large radius of curvature, r. This relatively large radius of curvature, r allows for a minor adjustment in the vertical alignment of the blocks 100*a,b*, if required, and provides for a stable hinge joint between stacked blocks 100*a,b*. The hinge joint allows a minor rotation of block 100*a* relative to 100*b* during shaking of a wall made of the blocks 100, for example, during seismic activity. Specifically, for a block 100 having a width, w, (see FIG. 4), the curved surfaces 124*a,b* typically have a radius of curvature, r, that is greater than approximately one twelfth of the block width (r>w/12). For example, for a block 100 having a width, w, of approximately six inches (6"), the radius of curvature, r, is typically about one-half inches (r≈0.5").

FIG. 3 shows that the sides 110, 112 of each block 100 are formed with a notch 128 immediately below each top face stop surface 118*a,b* to create a longitudinally aligned channel 130 with a bottom face stop surface 120*a,b*. The longitudinally aligned channel 130 is provided to simulate a decorative mortar joint between stacked blocks 100*a* and 100*b*. The channel 130 can be filled with mortar to simulate a mortar joint or can be left un-filled in which case the downward sloping curved surfaces 124 prevent water from seeping upward into the joint between blocks 100*a* and 100*b*.

Figure 5:
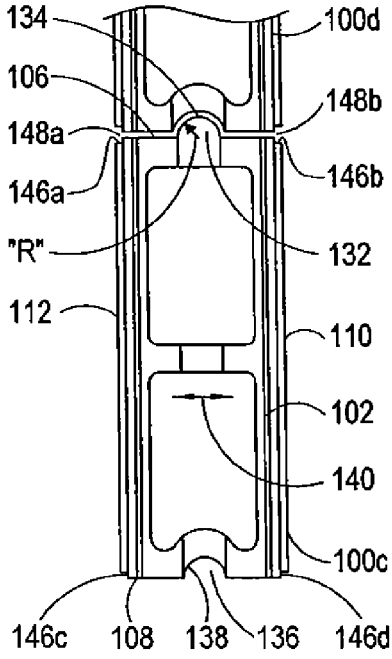
FIG. 5 is a top plan view of a pair of adjacent blocks in a common course.

FIG. 5 shows two adjacent blocks 100*c* and 100*d* in a common course. As shown, the end face 106 of each stretcher block 100 is formed with a vertically aligned tongue 132 (see also FIG. 1) that is positioned approximately midway between the two sides faces 110, 112. As further shown, the tongue 132 is formed with a tongue surface 134 having a relatively large radius of curvature, R. More specifically, the tongue surface 134 extends along the radius of curvature, R, approximately one-hundred eighty degrees. Thus, it can be seen that the tongue 132 is shaped as a semi-circle in a horizontal cross-section through the tongue 132.

Cross referencing FIGS. 2 and 5, it can be seen that the end face 108 of each stretcher block 100 is formed with a vertically aligned groove 136 having a groove surface 138 that is substantially conformal with the tongue surface 134. With this cooperation of structure, the groove 136 of block 100*d* closely receives and engages the tongue 132 of block 100*c* and prevents lateral movement of block 100*c* relative to the block 100*d* (i.e. movement in the direction of arrow 140 is prevented). Flat surfaces 142*a,b* (shown in FIG. 1) interact with respective flat surfaces 144*a,b* (shown in FIG. 2) to longitudinally align adjacent blocks 100*c,d*.

FIG. 5 shows that the tongue surface 134 and groove surface 138 are formed with a relatively large radius of curvature, R. Note: typically the groove surface 138 is formed with a slightly larger radius than the tongue surface 134 to ensure an easy fit between the tongue 132 and groove 136. The relatively large radius of curvature, R, allows for a minor adjustment in the longitudinal alignment of adjacent, common course blocks 100*c,d*, if required, and provides for a stable hinge joint between adjacent, common course blocks 100*c,d*. The hinge joint allows a minor rotation of block 100*c* relative to 100*d* during shaking of a wall made of the blocks 100, for example, during seismic activity. Specifically, for a block 100 having a width, w, the tongue surface 134 typically has a radius of curvature, R, that is greater than approximately one fourth of the block width (R>w/4). For example, for a block 100 having a width, w, of approximately six inches (6"), the radius of curvature, r, is typically about one and one-half inches (r≈1.5").

FIG. 5 shows that the sides 110, 112 of each block 100 are formed with notches 146*a-d* to create vertically aligned channels 148*a,b* between adjacent, common course blocks 100*c,d*. The vertically aligned channels 148*a,b* are provided to simulate a decorative mortar joint between adjacent, common course blocks 100*c,d*. The channel 148 can be filled with mortar to simulate a mortar joint or can be left un-filled. In some cases, the side surfaces 110, 112 including the channels 130, 148*a* and 148*b* can be covered with plaster after wall construction to enhance the appearance of the wall.

As best seen in FIG. 1, the block 100 is formed with two holes 149*a,b* which extend vertically through the block 100. These holes 149*a,b* reduce the weight of the block 100 as well as the amount of material needed to make the block 100. In addition, the holes 149*a,b* are positioned for alignment with holes 149*a,b* of blocks 100 on adjacent block courses to establish vertically aligned passageways that can be filled with mortar, and in some cases, re-bar to strengthen the wall.

Figure 6:
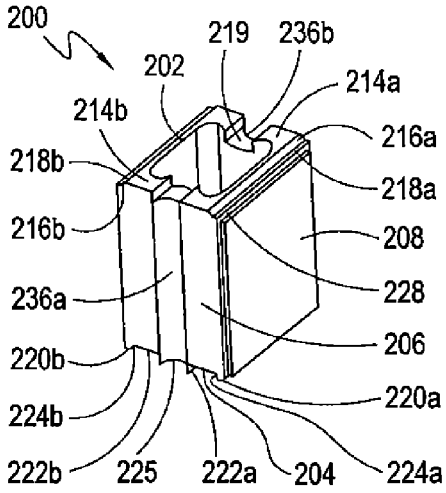
FIG. 6 is a front perspective view of a half-stretcher block for use in a mortarless joint block construction system.

Referring now to FIG. 6, a half-stretcher block 200 for use in a block construction system, for example with block 100 (see FIG. 1) is shown. As shown in FIG. 6, the half-stretcher block 200 includes a top face 202 and an opposed bottom face 204 that each extend longitudinally from an end face 206 to an end face 208. As further shown, the top face 202 is formed with flat, raised portions 214*a,b*, and longitudinally aligned edges 216*a,b* that are rounded and extend downwardly from a respective raised portion 214*a,b* to prevent water from entering the interface between stacked blocks 200. The top face 202 is further formed with a pair of substantially flat horizontal stop surfaces 218*a,b* and a longitudinally aligned, rectangular shaped slot 219.

Continuing with reference to FIG. 6, it can be seen that the bottom face 204 is formed with a pair of longitudinally aligned stop surfaces 220*a,b*, two flat, recessed portions 222*a,b* and a pair of curved surfaces 224*a,b* that are shaped to substantially conform to the rounded edges 216*a,b* on the top face 202, as shown. Also, the bottom face 204 is formed with a longitudinally aligned, rectangular shaped tongue 225 sized for insertion into a corresponding slot 219. FIG. 6 shows that the block 200 is formed with a notch 228 immediately below each top face stop surface 218*a* to create a decorative mortar joint. In addition, the end face 206 is formed with a vertically aligned groove 236*a* and the end face 208 is formed with a vertically aligned groove 236*b*, each sized to closely receive a corresponding tongue, such as the tongue 132 of block 100 shown in FIG. 1. It is to be appreciated that the above described cooperation of structure allows the half-stretcher block 200 to be used in a wall together with other blocks in the system such as block 100 described in detail above. Specifically, the block 200 can be stacked above or below a block 100 or can be positioned adjacent to a block 100 on a common course.

Figure 7:
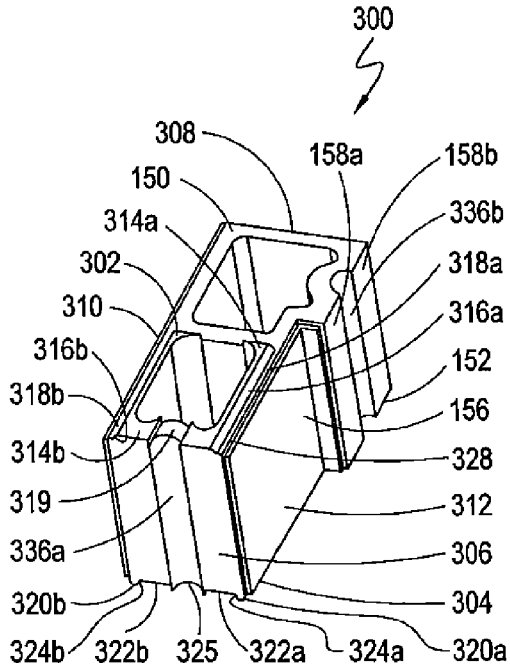
FIG. 7 is a front perspective view of a corner block for use in a mortarless joint block construction system.

Referring now to FIG. 7, a corner block 300 for use in a block construction system, for example with block 100 (see FIG. 1) is shown. It is to be appreciated that corner block 300 shown is a left corner block and that a typical block construction system would include both left and right corner blocks. As shown in FIG. 7, the corner block 300 includes a top face 302 and an opposed bottom face 304 that each extend longitudinally from an end face 306 to a substantially flat end face 308. As further shown, a portion of the top face 302 is formed with flat, raised portions 314*a,b*, longitudinally aligned edges 316*a,b* that are rounded and extend downwardly from a respective raised portion 314*a,b* to prevent water from entering the interface between stacked blocks 300. The top face 302 is further formed with a pair of substantially flat horizontal stop surfaces 318*a,b* and a longitudinally aligned, rectangular shaped slot 319. Also shown, the top face 302 includes a substantially flat corner portion 150.

Continuing with reference to FIG. 7, it can be seen that a portion of the bottom face 304 is formed with a pair of longitudinally aligned stop surfaces 320*a,b*, two flat, recessed portions 322*a,b* and a pair of curved surfaces 324*a,b* that are shaped to substantially conform to the rounded edges 316*a,b* on the top face 302, as shown. Also, a portion of the bottom face 304 is formed with a longitudinally aligned, rectangular shaped tongue 325 sized for insertion into a corresponding slot 319. FIG. 7 shows that the block 300 is formed with a notch 328 immediately below each top face stop surface 318*a* to create a decorative mortar joint. In addition, the bottom face 304 is formed with a substantially flat corner portion 152 to correspond with a substantially flat corner portion 150 of a top surface 302 when one corner block 300 is stacked on another corner block 300. In addition, the end face 306 is formed with a vertically aligned groove 336*a* sized to closely receive a corresponding tongue, such as the tongue 132 of block 100 shown in FIG. 1.

Continuing with FIG. 7, it can be seen that the corner block includes a substantially flat side face 310 and a side face 312 having a substantially flat portion 156. Side face 312 is also formed with flat surfaces 158*a,b*, which project slightly from the flat portion 156, and groove 336*b* that is sized to closely receive a corresponding tongue, such as the tongue 132 of block 100 shown in FIG. 1. It is to be appreciated that the above-described cooperation of structure allows the corner block 300 to be used in a wall together with other blocks in the system such as blocks 100 or 200 described above.

Figure 8:
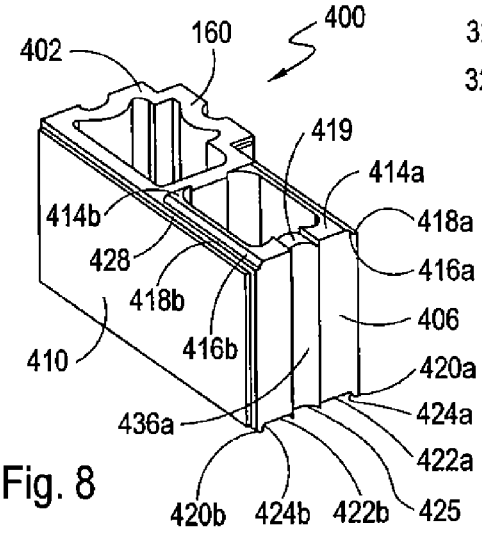
FIG. 8 is a front perspective view of a tee block for use in a mortarless joint block construction system.
Figure 9:
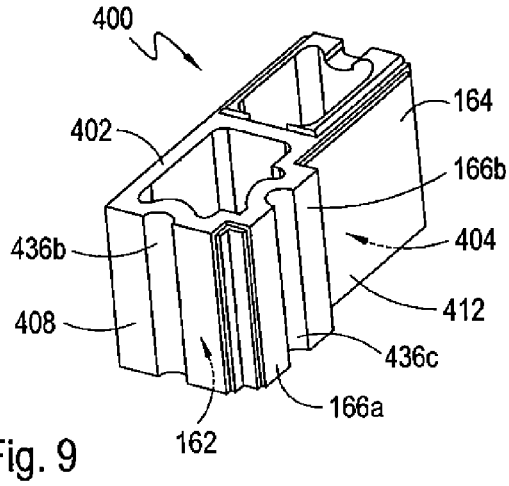
FIG. 9 is a rear perspective view of the tee block shown in FIG. 8.

Referring now to FIGS. 8 and 9, a tee block 400 for use in a block construction system, for example with block 100 (see FIG. 1) is shown. As shown in FIGS. 8 and 9, the tee block 400 includes a top face 402 and an opposed bottom face 404 that each extend longitudinally from an end face 406 to an end face 408. As further shown, a portion of the top face 402 is formed with flat, raised portions 414*a,b*, longitudinally aligned edges 416*a,b* that are rounded and extend downwardly from a respective raised portion 414*a,b* to prevent water from entering the interface between stacked blocks 400. The top face 402 is further formed with a pair of substantially flat, horizontal stop surfaces 418*a,b* and a longitudinally aligned, rectangular shaped slot 419. Also shown, the top face 402 includes a substantially flat tee portion 160.

Continuing with reference to FIGS. 8 and 9, it can be seen that a portion of the bottom face 404 is formed with a pair of longitudinally aligned stop surfaces 420*a,b*, two flat, recessed portions 422*a,b* and a pair of curved surfaces 424*a,b* that are shaped to substantially, conform to the rounded edges 416*a,b* on the top face 402, as shown. Also, a portion of the bottom face 404 is formed with a longitudinally aligned, rectangular shaped tongue 425 sized for insertion into a corresponding slot 419. FIGS. 8 and 9 show that the block 400 is formed with a notch 428 immediately below top face stop surface 418*b* to create a decorative mortar joint. In addition, the bottom face 404 is formed with a substantially flat tee portion 162 to correspond with a substantially flat tee portion 160 of a top surface 402 when one tee block 400 is stacked on another tee block 400. In addition, the end face 406 is formed with a vertically aligned groove 436*a* sized to closely receive a corresponding tongue, such as the tongue 132 of block 100 shown in FIG. 1. Also, end face 408 is formed with a vertically aligned groove 436*b* sized to closely receive a corresponding tongue, such as the tongue 132 of block 100 shown in FIG. 1.

Continuing with FIGS. 8 and 9, it can be seen that the tee block 400 includes a substantially flat side face 410 and a side face 412 having a substantially flat portion 164. Side face 412 is also formed with flat surfaces 166*a,b*, which project slightly from the flat portion 164, and groove 436*c* that is sized to closely receive a corresponding tongue, such as the tongue 132 of block 100 shown in FIG. 1. It is to be appreciated that the above-described cooperation of structure allows the tee block 400 to be used in a wall together with other blocks in the system such as blocks 100 or 200 described above.

Figure 10:
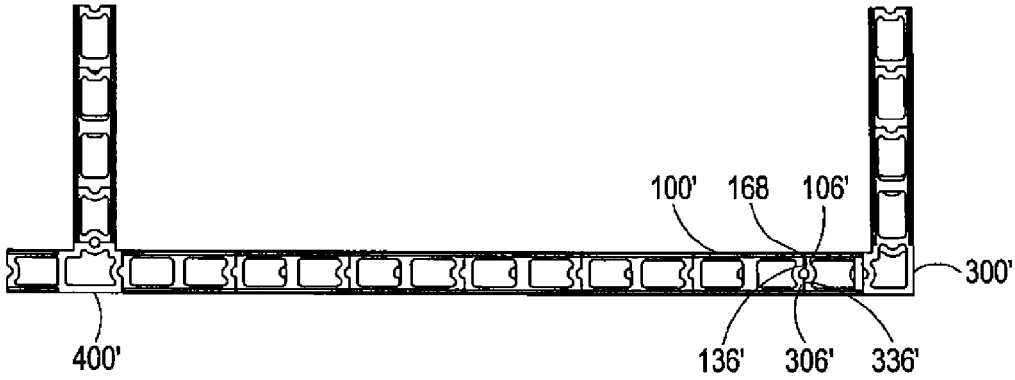
FIG. 10 is a top plan view of a course of blocks having stretcher blocks, a right corner block and a tee block.

FIG. 10 shows a portion of a course of blocks having stretcher blocks 100', a right corner block 300' and a tee block 400'. From FIG. 10, it can be seen that where an end face such as end face 106' having groove 136' is stacked against an end face 306' having groove 336*a*', the grooves 136', 336' form a cylindrical void 168 that can be filled with mortar to prevent lateral movement of block 100' relative to corner block 300'.

Figure 11:
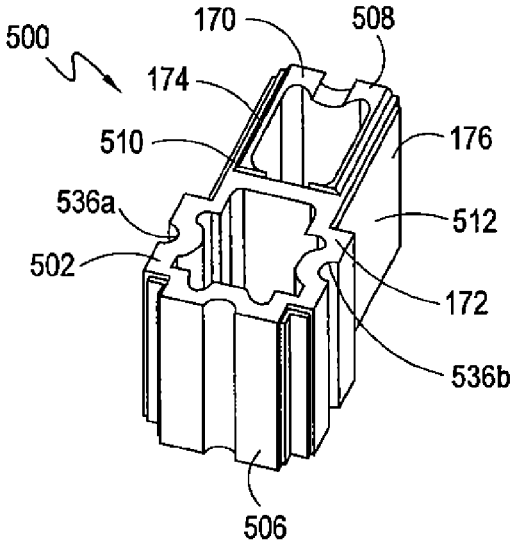
FIG. 11 is a front perspective view of a cross block for use in a mortarless joint block construction system.

Referring now to FIG. 11, a cross block 500 for use in a block construction system, for example with block 100 (see FIG. 1) is shown. As shown in FIG. 11, the cross block 500 includes a top face 502 which includes a first portion 170 having a profile similar to the profile of the top face 102 of block 100 shown in FIG. 1 and a second flat portion 172. Cross block 500 also includes end faces 506, 508 that are similar to end faces 106, 108 of block 100 shown in FIG. 1. Also, it can be seen that the cross block 500 includes side faces 510 and 512 that each have a substantially flat portion 174, 176 and a pair of flat surfaces which project slightly from a respective flat portion 174, 176, and each have a groove 536*a,b* that is sized to closely receive a corresponding tongue, such as the tongue 132 of block 100 shown in FIG. 1. It is to be appreciated that the above-described cooperation of structure allows the cross block 500 to be used in a wall together with other blocks in the system such as blocks 100 or 200 described above.

Figure 12:
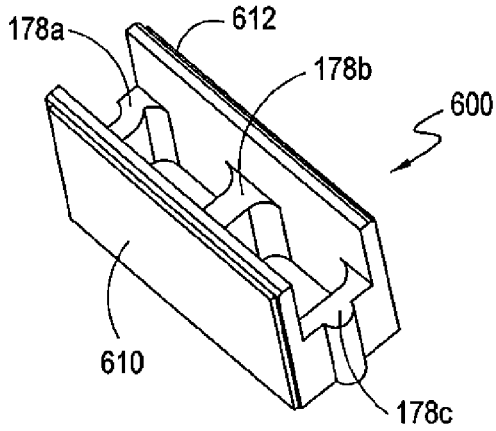
FIG. 12 is a front perspective view of a bond block for use in a mortarless joint block construction system.

Referring now to FIG. 12, a bond block 600 for use in a block construction system, for example with block 100 (see FIG. 1) is shown. As shown in FIG. 12, the bond block 600 includes a side faces 610, 612 which are similar to the respective side faces 110, 112 of block 100 shown in FIG. 1. However, as shown, the block 600 has been formed with support surfaces 178*a-c* at the approximate mid-height of the block 600 to support horizontally oriented re-bar. It is to be appreciated that the above-described cooperation of structure allows the bond block 600 to be used in a wall together with other blocks in the system such as blocks 100 or 200 described above.

Figure 13:
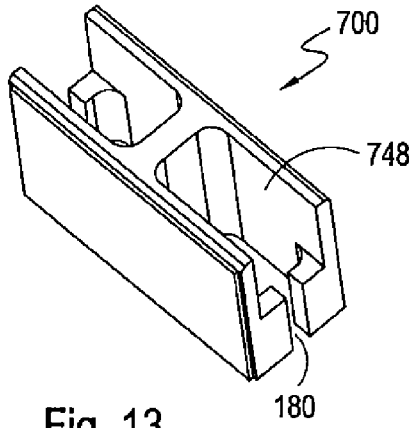
FIG. 13 is a front perspective view of a block for use in a mortarless joint block construction system having vertical re-bar.

Referring now to FIG. 13, a block 700 for use in a block construction system, for example with block 100 (see FIG. 1) is shown. As shown in FIG. 13, the block 700 is formed with a cutout 180 to accommodate vertically oriented re-bar. Specifically, the cutout 180 allows a piece of vertically oriented re-bar to be placed in the channel 748 without requiring the block 700 to be lifted above the vertically oriented re-bar. It is to be appreciated that the above-described cooperation of structure allows the block 700 to be, used in a wall together with other blocks in the system such as blocks 100 or 200 described above.

Figure 14:
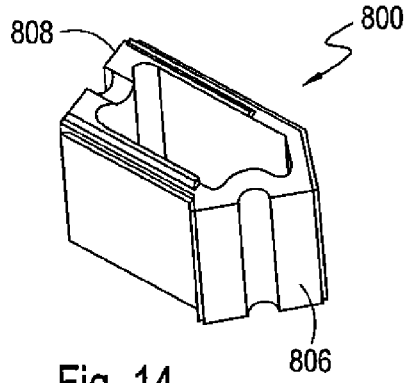
FIG. 14 is a front perspective view of a 45° block for use in a mortarless joint block construction system.

Referring now to FIG. 14, a 45° block 800 for use in a block construction system, for example with block 100 (see FIG. 1) is shown. As shown in FIG. 14, the 45° block 800 includes end faces 806, 808 which are similar to the respective end faces 106, 108 of block 100 shown in FIG. 1. However, as shown, the block 800 has been formed with end face 806 oriented at an angle of approximately 45° relative to end face 808. It is to be appreciated that the above-described cooperation of structure allows the 45° block 800 to be used in a wall together with other blocks in the system such as blocks 100 or 200 described above.

Figure 15:
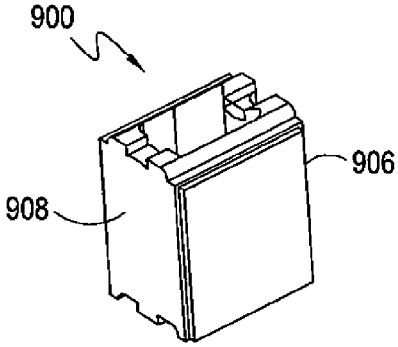
FIG. 15 is a front perspective view of an end block for use in a mortarless joint block construction system.

Referring now to FIG. 15, an end block 900 for use in a block construction system, for example with block 100 (see FIG. 1) is shown. As shown in FIG. 15, the end block 900 extends from end face 906 (which is similar to the end face 106 of block 100 shown in FIG. 1) to a flat end face 908. It is to be appreciated that the above-described cooperation of structure allows the end block 900 to be used in a wall together with other blocks in the system such as blocks 100 or 200 described above.

Figure 16:
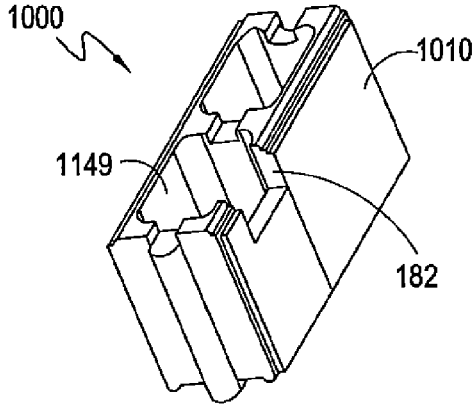
FIG. 16 is a front perspective view of a block formed with an opening for accommodating an electrical outlet.

Referring now to FIG. 16, a block 1000 for use in a block construction system, for example with block 100 (see FIG. 1) is shown. As shown in FIG. 16, the block 1000 is similar to block 100 shown in FIG. 1, but is formed with an opening 182 on side face 1010 for accommodating an electrical outlet (not shown). Specifically, an electrical receptacle can be disposed in opening 182 and wires from the receptacle can be routed through hole 1049. It is to be appreciated that the above-described cooperation of structure allows the block 1000 to be used in a wall together with other blocks in the system such as blocks 100 or 200 described above.

Figure 17:
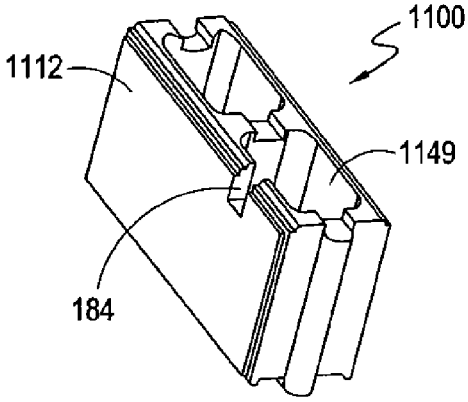
FIG. 17 is a front perspective view of a block formed with an opening for accommodating a plumbing line.

Referring now to FIG. 17, a block 1100 for use in a block construction system, for example with block 100 (see FIG. 1) is shown. As shown in FIG. 17, the block 1100 is similar to block 100 shown in FIG. 1, but is formed with an opening 184 on side face 1112 for accommodating a plumbing line (not shown). Specifically, a plumbing line such as a pipe can be routed within the wall through hole 1149 for exit from the wall through opening 184. It is to be appreciated that the above-described cooperation of structure allows the block 1100 to be used in a wall together with other blocks in the system such as blocks 100 or 200 described above.

Figure 18:
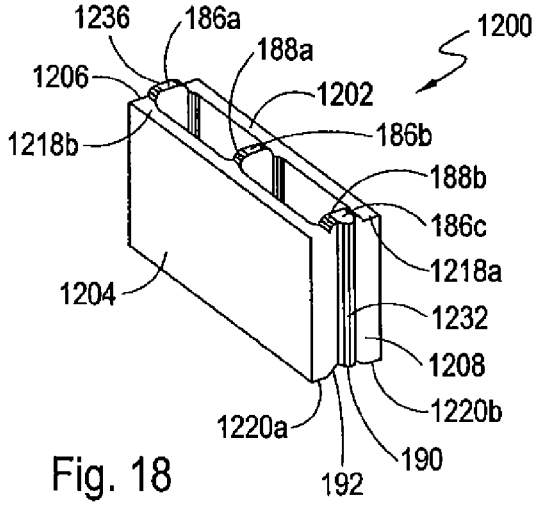
FIG. 18 is a front perspective view of an indoor block for use in a mortarless joint block construction system.

Referring now to FIG. 18, a block 1200 for use in an indoor block construction system is shown. As shown in FIG. 18, the block 1200 is somewhat similar to block 100 shown in FIG. 1, but typically has a width, w (see FIG. 4) of about four inches. As shown, block 1200 includes a top face 1202 and an opposed bottom face 1204 that each extend longitudinally from an end face 1206 to an end face 1208. As further shown, the top face 1202 is formed with flat, raised portions 186*a-c*, longitudinally aligned edges 188 (for which exemplary edges 188*a* and 188*b* have been labeled) that are rounded and extend downwardly from a respective raised portion 186. The top face 1202 is further formed with a pair of substantially flat horizontal stop surfaces 1218*a,b*.

Continuing with reference to FIG. 18, it can be seen that the bottom face 1204 is formed with a pair of longitudinally aligned stop surfaces 1220*a,b*, flat, recessed portions 190 and curved surfaces 192 that are shaped to substantially conform to the rounded edges 188 on the top face 1202, as shown. In addition, the end face 1208 is formed with a vertically aligned tongue 1232 and the end face 1206 is formed with a vertically aligned groove 1236 sized to closely receive a corresponding tongue 1232, for example, from another block 1200.

Figure 19:
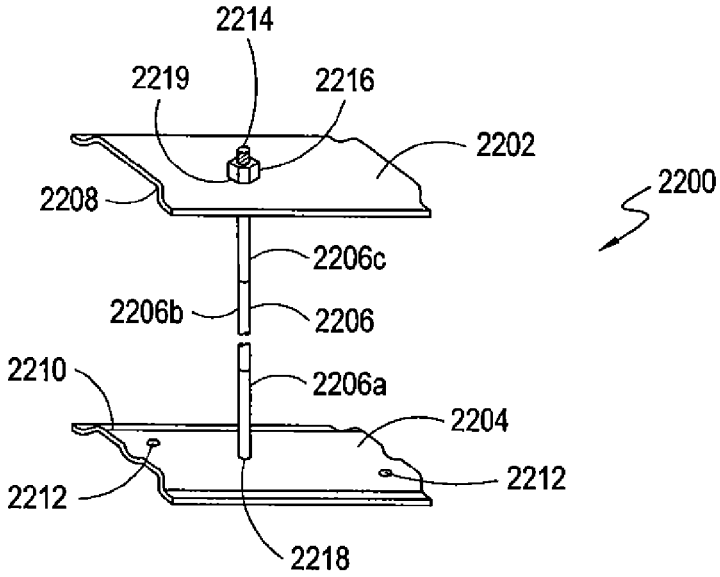
FIG. 19 is a perspective view of a structure for reinforcing a block wall.

Referring now to FIG. 19, a reinforcing system is shown and generally designated 2200. System 2200 includes an upper plate 2202, a lower plate 2204, and a connecting bar 2206 which extends vertically between the lower plate 2204 and the upper plate 2202.

Upper plate 2202 is formed with a surface 2208 which is shaped and sized to conform to the top face 102 of a construction block 100 (FIG. 1). Similarly, lower plate 2204 is formed with a surface 2210 that is shaped and sized to at least partially conform to the bottom face 104 of a block 100. Lower plate 2204 may also be formed with one or more mounting holes 2212 to facilitate nailing, screwing, or otherwise attaching lower plate 2204 to the ground. Also, lower plate 2204 may be formed with a threaded hole 2218 to receive the end of connecting bar 2206 that is formed with corresponding threads. The upper end of connecting bar 2206 may be formed with thread 2214 to receive a threaded nut 2216 once the connecting bar 2206 has been inserted through hole 2219 formed in the upper plate 2202. In a preferred embodiment, connecting bar 2206 may be constructed of several shorter bar segments 2206*a*, 2206*b*, and 2206*c*. In this manner, as will be discussed in greater detail below in conjunction with FIG. 20, the connecting bar 2206 may be installed into a wall constructed of the building blocks of the present invention once the wall is fully erected.

Figure 20:
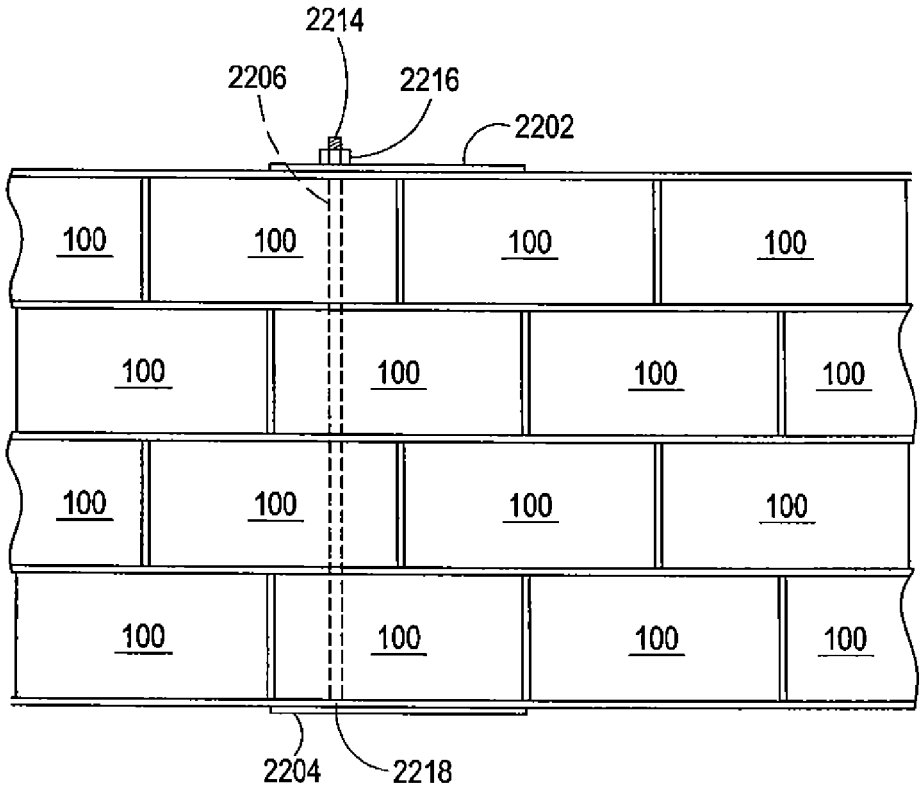
FIG. 20 is a side view of a block wall incorporating the reinforcing structure shown in FIG. 19.

Referring now to FIG. 20, a wall constructed of the building blocks 100 of the present invention, and incorporating the reinforcing system 2200 is shown with the vertical connecting bar 2206 shown in phantom. In use, the lower plate 2204 is positioned in place, and then a wall is constructed, such as the wall shown constructed of blocks 100 of the present invention.

Once the wall has been completed, the vertical connecting bar 2206 is inserted down into the holes 149 of blocks 100 and threaded into threaded hole 2218. The construction of vertical connecting bar 2206 from several smaller pieces of bar, such as shown by vertical connecting bar pieces 2206*a*, 2206*b* and 2206*c*, allow for the insertion of a full-length connecting bar 2206, despite construction of a wall of the present invention in locations with limited clearance above the walls.

Once the vertical connecting bar 2206 has been properly attached to lower plate 2204, upper plate 2202 is positioned on top of the blocks 100 such that the vertical connecting bar 2206 extends through hole 2219 and rests on the top face 102 of the block 100. Once the upper plate 2202 is in position atop block 100, nut 2216 is threaded onto threads 2214 of connecting bar 2206 and tightened. As the nut 2216 tightens, the blocks 100 of the wall are captured firmly between the upper plate 2202 and the lower plate 2204 thereby preventing the relative movement of any block 100 within the wall. In fact, several reinforcing systems 2200 may be used in the same wall to provide for a block construction system which does not need mortar or concrete encased rebar in order to maintain its structural rigidity. Also, by not using any concrete or mortar in the formation of a wall incorporating the building blocks of the present invention, the wall may be erected, equipped with the reinforcing system 2200, and used for an extended period of time, yet providing for the easy demolition, removal, and re-use of the blocks 100.

While the particular block construction system as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A block construction system comprising:

a first block defining a longitudinal axis and having a top face and a bottom face with opposed side faces and opposed end faces extending therebetween, wherein said top face is formed with at least one substantially flat horizontal raised portion positioned between a pair of longitudinally aligned rounded edges, wherein said top face is further formed with a pair of substantially flat horizontal stop surfaces, with each said stop surface positioned between a respective rounded edge and a respective side face, and wherein said first block forms an opening extending vertically between said top face and said bottom face, with said opening being positioned between said rounded edges; and a second block defining a longitudinal axis and having a top face and a bottom face with opposed side faces and opposed end faces extending therebetween, wherein said bottom face is formed with at least one substantially flat recessed portion positioned between a pair of longitudinally aligned curved surfaces that are shaped to substantially conform to said edges on said top face, said recessed portion for engaging said raised portion when said second block is stacked on said first block, wherein said bottom face is further formed with a pair of substantially flat horizontal stop surfaces, with each said stop surface positioned between a respective curved surface and a respective side face, said bottom face stop surfaces for engaging said top face stop surfaces to vertically align said first block with said second block, and wherein said second block forms an opening extending vertically between said top face and said bottom face of said second block with said second block opening being positioned between said curved surfaces, and further wherein said openings of said first block and said second block are vertically aligned when said second block is stacked on said first block to form a passageway through said blocks for receiving a support member.

2. A system as recited in claim 1 wherein said top face has a width, w, transverse to said longitudinally aligned rounded edges, said rounded edges have a radius of curvature, r, with said radius of curvature being greater than approximately one twelfth of said block width ($r>w/12$).

3. A system as recited in claim 2 wherein said radius of curvature, r, is approximately one-half inches ($r\approx0.5$ in.).

4. A system as recited in claim 1 wherein each said side is formed with a notch immediately below each said top face stop surface, each said notch for creating a longitudinally aligned channel with a said bottom face stop surface to simulate a mortar joint between said first and second blocks.

5. A system as recited in claim 1 wherein each said block is formed with a first end face and a second end face with said first end face formed with a vertically aligned tongue having a tongue surface with a radius of curvature, R, said tongue surface extending along said radius of curvature, R, approximately one-hundred eighty degrees, and said second end formed with a vertically aligned groove having a groove surface substantially conformal with said tongue surface to receive a said tongue from an adjacent block in a common course.

6. A system as recited in claim 5 wherein said top face has a width, w, transverse to said longitudinally aligned rounded edges and said radius of curvature of said tongue surface, R is greater than approximately one fourth the width of said block ($r>w/4$).

7. A system as recited in claim 5 wherein said radius of curvature of said tongue surface, R, is approximately one and one-half inches ($r\approx1.5$ in.).

8. A block for use in a construction system utilizing a plurality of said blocks, said block defining a longitudinal axis and comprising:

a first end face and a second end face substantially parallel to each other and substantially perpendicular to the axis;

a first side face and a second side face substantially parallel to each other and to the axis;

a top face substantially parallel to the axis, with said top face including a pair of substantially planar stop surfaces terminating at respective side faces, a pair of longitudinally aligned rounded edges abutting respective shoulder surfaces, and a substantially planar raised surface positioned between the pair of rounded edges, wherein the raised portion is raised from the stop surfaces;

a bottom face substantially parallel to the top face and the axis, with said bottom face including a pair of substantially planar stop surfaces terminating at respective side faces and dimensioned to engage the stop surfaces on the top face of a juxtaposed block, a pair of longitudinally aligned curved surfaces abutting respective stop surfaces on the bottom lace, with the curved surfaces dimensioned to engage the rounded edges on the top face of the juxtaposed block, and a substantially planar recessed surface positioned between the pair of curved surfaces, wherein the recessed surface is recessed from the stop surfaces of the bottom face and is dimensioned to engage the raised surface of the top face of the juxtaposed block; and an opening perpendicular to the axis and extending between said top face and said bottom face, with said opening being positioned between said rounded edges and said curved surfaces, wherein the opening aligns with the opening in the juxtaposed block to form a passageway to receive a support member.

9. A block as recited in claim 8 wherein the second end face is formed with a vertically extending tongue having a tongue surface with a radius of curvature, R, wherein said tongue surface extends along said radius of curvature, R, approximately one-hundred eighty degrees, with said tongue positioned approximately midway between said side faces of said block; and wherein said first end face is formed with a vertically extending groove having a groove surface substantially conformal with said tongue surface, said groove for receiving said tongue of a selected block positioned adjacent to said block in a common course to align the adjacent blocks and establish a hinge joint therebetween to accommodate minor vibration of said adjacent blocks during the service life of said system.

10. A system as recited in claim 9 wherein said end face of said block has a width, w, and said radius of curvature of said tongue surface, R is greater than approximately one fourth the width of said block (r>w/4).

11. A system as recited in claim 9 wherein said radius of curvature of said tongue surface, R, is approximately one and one-half inches (r≈1.5 in.).

12. A system as recited in claim 8 wherein said top face has a width, w, and said rounded edges have a radius of curvature, r, with said radius of curvature being greater than approximately one twelfth of said block width (r>w/12).

13. A system as recited in claim 12 wherein said radius of curvature, r, is approximately one-half inches (r≈0.5 in.).

14. A block as recited in 8 wherein the first end face includes a vertically-extending groove and the second end face includes a vertically-extending tongue dimensioned to engage the groove on the first end face of an adjacent block.

15. A block as recited in claim 14 wherein the top face includes a longitudinally-extending central slot formed in the raised portion, and wherein the bottom face includes a longitudinally-extending central tab formed in the recessed portion, with the tab dimensioned to engage the slot of the juxtaposed block.

16. A block as recited in claim 15 wherein the slot, tab, groove and tongue of the block are co-planar.

17. A block as recited in claim 8 wherein the first end face defines a vertical cutout extending through the top face and the bottom face, with said vertical cutout being in communication with the opening for insertion of a support element through the vertical cutout and into the passageway formed by a column of juxtaposed blocks.

18. A method for constructing a structure from a plurality of blocks comprising the steps of:

providing a plurality of blocks, with each block defining a longitudinal axis and comprising a first end face and a second end face substantially parallel to each other and substantially perpendicular to the axis, a first side face and a second side face substantially parallel to each other and to the axis, a top face and a bottom face substantially parallel to each other and to the axis, wherein said top face includes a pair of substantially planar stop surfaces terminating at respective side faces, a pair of longitudinally aligned rounded edges abutting respective shoulder surfaces, and a substantially planar raised surface positioned between the pair of rounded edges, with the raised portion being raised from the stop surfaces, wherein said bottom face includes a pair of substantially planar stop surfaces terminating at respective side faces and dimensioned to engage the stop surfaces on the top face of a juxtaposed block, a pair of longitudinally aligned curved surfaces abutting respective stop surfaces on the bottom face, with the curved surfaces dimensioned to engage the rounded edges on the top face of the juxtaposed block, and a substantially planar recessed surface positioned between the pair of curved surfaces, with the recessed surface being recessed from the stop surfaces of the bottom face and is dimensioned to engage the raised surface of the top face of the juxtaposed block, and wherein each block includes an opening perpendicular to the axis and extending between said top face and said bottom face, with said opening being positioned between said rounded edges and said curved surfaces;

placing a block in a desired location;

juxtaposing another block on the placed block, with said rounded edges of the placed block and said curved surfaces of the juxtaposed block directing the blocks into a proper alignment with the openings forming a vertically extending passageway; and inserting a support element into the passageway.

19. A method as recited in claim 18 wherein the first end face of each block includes a vertically-extending groove and the second end face of each block includes a vertically-extending tongue dimensioned to engage the groove of an adjacent block, the method further comprising the step of:

positioning a selected block adjacent to the placed block with said groove of said selected block engaging said tongue of said placed block to align and secure the placed and selected blocks.

20. A method as recited in claim 18 wherein the first end face of each block defines a vertical cutout extending through the top face and the bottom face with said vertical cutout being in communication with the opening, the method further comprising the step of repeating the juxtaposing step to erect a column of blocks; and wherein, in the inserting step, the support element is inserted into the passageway of the column of juxtaposed blocks through the vertical cutouts in the blocks.

* * * * *